US010593471B2

(12) United States Patent
Hashimoto

(10) Patent No.: US 10,593,471 B2
(45) Date of Patent: Mar. 17, 2020

(54) METHOD FOR PRODUCING PERMANENT MAGNET MAGNETIC CIRCUIT

(71) Applicant: SHIN-ETSU CHEMICAL CO., LTD., Tokyo (JP)

(72) Inventor: Shingo Hashimoto, Fukui-ken (JP)

(73) Assignee: Shin-Etsu Chemical Co., Ltd. (JP)

( * ) Notice: Subject to any disclaimer, the term of this patent is extended or adjusted under 35 U.S.C. 154(b) by 416 days.

(21) Appl. No.: 15/251,750

(22) Filed: Aug. 30, 2016

(65) Prior Publication Data

US 2017/0062126 A1 Mar. 2, 2017

(30) Foreign Application Priority Data

Sep. 2, 2015 (JP) ..... 2015-172642

(51) Int. Cl.
*H01F 41/02* (2006.01)
*H01F 7/02* (2006.01)
*H01F 13/00* (2006.01)

(52) U.S. Cl.
CPC ..... *H01F 41/0253* (2013.01); *H01F 7/021* (2013.01); *H01F 7/0273* (2013.01); *H01F 13/003* (2013.01)

(58) Field of Classification Search
CPC ... H01F 41/0253; H01F 7/021; B32B 37/025; B32B 43/006
See application file for complete search history.

(56) References Cited

U.S. PATENT DOCUMENTS

2002/0171526 A1 11/2002 Evangelos et al.
2003/0111921 A1* 6/2003 Honkura ..... H01F 7/021 310/154.12
2003/0234712 A1* 12/2003 Inase ..... H01F 41/0253 335/296
2012/0098271 A1 4/2012 Bayer et al.
2014/0374032 A1 12/2014 Heucher et al.

FOREIGN PATENT DOCUMENTS

JP 2008-339916 12/1996
JP H08339916 A 12/1996
JP 2004-328927 A 11/2004

OTHER PUBLICATIONS

European Search Report for Application No. 16186056.4 dated Feb. 7, 2017.

* cited by examiner

*Primary Examiner* — Christopher T Schatz
(74) *Attorney, Agent, or Firm* — Lerner, David, Littenberg, Krumholz & Mentlik, LLP

(57) ABSTRACT

There is provided a method for producing a permanent magnet magnetic circuit that makes it possible to stably attach a permanent magnet to a yoke and to use a general-purpose assembly jig or to reuse an existing assembly jig even when the size or shape of a magnet to be attached is changed. More specifically, there is provided a method for producing the circuit comprising a magnet or magnet unit and a yoke, the method comprising the steps of: fixing the magnet or magnet unit to an assembly jig through an electrically detachable adhesive; fixing the magnet or magnet unit fixed to the jig, to the yoke; and applying a voltage between the magnet or magnet unit and the assembly jig to detach the adhesive from the magnet or magnet unit to detach the adhesive from the jig so as to detach the magnet from the jig.

5 Claims, 10 Drawing Sheets

METHOD FOR PRODUCING PERMANENT MAGNET MAGNETIC CIRCUIT

RELATED APPLICATION

The present application claims priority to Japanese Patent Application No. 2015-172642 filed Sep. 2, 2015, the disclosure of which is incorporated by reference in its entirety.

BACKGROUND OF THE INVENTION

1. Field of the Invention

The invention relates to a method for producing a permanent magnet magnetic circuit, comprising the a step of attaching a permanent magnet to a yoke by using an assembly jig.

2. Description of the Related Art

Rare-earth sintered permanent magnets typically represented by neodymium (Nd) are extensively used for various types of rotators such as those in wind power generators, air conditioners and hybrid vehicles, or for magnetic field generators such as those in medical MRI devices, because of their high magnetic properties. Especially in recent years, large magnetic circuits for obtaining high outputs as in the wind power generation on the ocean have been produced. The production of such a large magnetic circuit involves a large magnet having a diameter of, for example, more than one meter. However, it is currently impossible to make such a large permanent magnet in one piece by a powder metallurgy process. Accordingly, usually, a plurality of permanent magnets such as 10 cm cubes of magnets are combined to form a large permanent magnet unit.

There are two types of methods for attaching a plurality of permanent magnets to a yoke. In one of the methods, unmagnetized magnets are attached to a yoke and then magnetized (i.e. assembly-before-magnetization method). In the other of the methods, magnets that have already been magnetized are directly attached to a yoke (i.e. assembly-after-magnetization method). In the assembly-before-magnetization method, unmagnetized magnets are used so that there is neither attraction force nor repulsive force generated between the magnets and a yoke during the assembly and the assembly work is extremely easy, making it possible to manually assemble a magnetic circuit. However, the assembly-before-magnetization method can be implemented only if the magnets have magnetization directions that are uniform to an extent which will permit the magnetization after assembly, and the magnetic circuit after assembly has a size that is small to an extent which will permit the magnetization. Particularly in the case of a large magnetic circuit, an extremely large magnetizing device is required for the magnetization after the assembly, so that the assembly-before-magnetization method is in most cases substantially impossible to carry out. In such cases, the assembly-after-magnetization method, in which already magnetized magnets are used, is carried out. However, in the assembly-after-magnetization method for attaching magnets to a yoke, attraction forces and repulsive forces are generated between the magnets and the yoke or between the magnets to be assembled and the magnets which have already been assembled, thus making it difficult to stably assemble the magnets. For this reason, a solid, highly rigid assembly jig must be used to attach the magnets to the yoke. As an example of the assembly jig, a slide-in jig for sliding a magnet to a yoke by, for example, a ball screw is used (e.g. JP 08-339916A).

SUMMARY OF THE INVENTION

To assemble a permanent magnet magnetic circuit by using an assembly jig, a permanent magnet has to be fixed to the assembly jig first. Further, the permanent magnet is placed at a desired position on a yoke, and after fixing the permanent magnet to the yoke, the permanent magnet has to be detached from the assembly jig. However, the mechanical properties of sintered rare-earth permanent magnets are similar to those of ceramic materials, so that it is not easy to grind, cut or drill the permanent magnets by a lathe or a milling machine, and it is extremely difficult to tap or make a dovetail groove in the permanent magnets. Thus, retaining of a discrete magnet on an assembly jig remains an important issue to be addressed.

As a conventional method for fixing a magnet to an assembly jig, there is, for example, a method in which a magnet is fixed to an assembly jig by a frictional force or an attraction force that overcomes the attraction force or the repulsive force between a magnet and a yoke. FIG. 13 shows a schematic diagram illustrating an example of a magnet-fixing section of a conventional assembly jig. A permanent magnet 2, which has been magnetized, is physically fixed to a magnet-fixing section 104*a* of an assembly jig. The magnet-fixing section 104*a* is shaped to cover the permanent magnet 2 and configured to be capable of physically fixing the permanent magnet 2 by pressing the permanent magnet 2 with a screw 108. Further, FIGS. 14A and 14B show schematic diagrams illustrating another example of a magnet-fixing section of a conventional assembly jig. FIG. 14A shows a side schematic view and FIG. 14B shows a schematic view of the magnet-fixing section observed from a side C in the direction indicated by a dashed-line arrow. FIGS. 14A and 14B show the permanent magnet 2, which has been magnetized, is fixed to the magnet-fixing section 104*a* by the attraction force of magnetic material 109. However, it is required to select the sizes, shapes and the like of the magnet-fixing section 104*a* and the magnetic material 109 shown in FIG. 13 and FIGS. 14A and 14B, corresponding to the sizes, shapes and the like of the permanent magnet 2 and a yoke 3. Therefore, each time a permanent magnet magnetic circuit to be produced is changed, a new assembly jig having the magnet-fixing section 104*a* and the magnetic material 109 of different sizes, shapes and the like must be fabricated.

Further, in the case where a magnet unit having a magnetic or nonmagnetic backplate attached to a permanent magnet in an integrated form is fixed to a yoke, the backplate is tapped to make a screw hole so as to allow the magnet unit to be fixed to an assembly jig by using a fixture such as a screw. For example, FIGS. 15A and 15B show schematic diagrams illustrating an example of a magnet-fixing section of a conventional assembly jig. FIG. 15A shows a side schematic view and FIG. 15B shows a schematic view of the magnet-fixing section observed from a side D in the direction indicated by a dashed-line arrow. FIGS. 15A and 15B show the magnet unit 107 fixed to the magnet-fixing section 104*a* of the assembly jig by the screw 108 by using the screw hole (not shown) formed in the backplate 106 of the magnet unit 107, which has been magnetized. The magnet-fixing section 104*a* has a through hole (not shown), and the diameter and the position of the through hole are changed according to the size or the position of the screw hole formed in the backplate 106. The size or the position of the screw hole formed in the backplate 106 is changed according to the size, the shape and the like of the permanent magnet 2, and therefore, whenever the permanent magnet magnetic circuit to be produced is changed, the assembly jig comprising the magnet-fixing section 104*a* having the diameter or the position of the through hole changed has to be remade.

The assembly jig is required to be solid and highly rigid to survive the attraction force and the repulsive force between magnets and a yoke, thereby resulting in high fabrication cost. A dedicated assembly jig may be fabricated for permanent magnet magnetic circuits to be mass-produced. In the trial production or small-volume production of permanent magnet magnetic circuits, it is desirable to use a general-purpose assembly jig or reuse an assembly jig that has been fabricated in the past. However, when the permanent magnet magnetic circuit to be produced is changed, the size and the shape of a magnet are changed so that the magnetic-fixing section of an assembly jig has to be changed each time accordingly, thereby posing a problem of extra design labor and cost.

In view of the aforesaid current situation, an object of the invention is to provide a method for producing a permanent magnet magnetic circuit that makes it possible to stably attach a permanent magnet to a yoke and to use a general-purpose assembly jig or to reuse an existing assembly jig without changing the assembly jig even when a permanent magnet magnetic circuit to be produced is changed and the size or the shape of a magnet to be assembled to is therefore changed.

The inventors have keenly studied to solve the problem and found that it is possible to efficiently assemble a permanent magnet magnetic circuit by using a general-purpose assembly jig or reusing an existing assembly jig without adding any changes to an assembly jig even when a permanent magnet magnetic circuit to be produced is changed and therefore the size or the shape of a magnet to be used is changed. The inventors have found that it can be done by attaching a permanent magnet or magnet unit having a backplate bonded to a permanent magnet in an integrated form, to an assembly jig through an electrically detachable adhesive having a detaching property upon passing of electric current. Thus, the inventors have arrived at the invention. Fixing a permanent magnet to an assembly jig through an electrically detachable adhesive makes it possible to successfully deal with a change of the size or the shape of a permanent magnet by controlling the application area or the amount of the adhesive, so that the need for changing the structure of an assembly jig itself is eliminated. After fixing the permanent magnet to a yoke, the permanent magnet can be easily detached from the assembly jig by passing of electric current.

More specifically, according to the invention, there is provided a method for producing a permanent magnet magnetic circuit comprising a permanent magnet or magnet unit having a permanent magnet fixed to a backplate and a yoke on which the permanent magnet or magnet unit is placed, the method comprising the steps of: fixing the permanent magnet or magnet unit to an assembly jig through an electrically detachable adhesive; fixing the permanent magnet or magnet unit, which has been fixed to the assembly jig, to the yoke; and applying a voltage between the permanent magnet or magnet unit and the assembly jig to detach the electrically detachable adhesive from the permanent magnet or magnet unit or to detach the electrically detachable adhesive from the assembly jig so as to detach the permanent magnet or magnet unit from the assembly jig.

According to the invention, a method for producing a permanent magnet magnetic circuit can be provided, which makes it possible to stably attach a permanent magnet to a yoke and to use a general-purpose assembly jig or reuse an existing assembly jig without changing the assembly jig even when a permanent magnet magnetic circuit to be produced is changed and the size or the shape of a magnet to be attached is changed.

BRIEF DESCRIPTION OF THE DRAWINGS

FIGS. 3A and 3B show schematic diagrams illustrating an example of a step of attaching magnetized magnets to a yoke in a method for producing a permanent magnet magnetic circuit in accordance with the invention, wherein FIG. 3A shows a side schematic diagram and FIG. 3B shows a schematic diagram observed from a side A in the direction indicated by a dashed-line arrow;

FIGS. 8A, 8B, and 8C show schematic diagrams illustrating examples of a magnet unit having a permanent magnet fixed to a backplate, wherein FIG. 8A shows an example of magnet unit comprising a permanent magnet and a backplate alone, FIG. 8B shows an example of magnet unit in which an electric resistance regulator plate is attached to a surface of the backplate that is in contact with an electrically detachable adhesive, and FIG. 8C shows an example of magnet unit in which an electric resistance regulator plate is attached to a surface where the electrically detachable adhesive is in contact with both of the permanent magnet and the backplate, in such a manner that the electric resistance regulator plate extends over the permanent magnet and the backplate;

FIGS. 9A and 9B show a schematic diagram illustrating an example of a step of attaching a magnetized magnet to a yoke in the method for producing a permanent magnet magnetic circuit in accordance with the invention in which a permanent magnet is fixed to a backplate to form a magnet unit, wherein FIG. 9A shows a side schematic diagram and FIG. 9B shows a schematic diagram observed from a side B in the direction indicated by an dashed-line arrow;

FIGS. 14A and 14B show a schematic diagram illustrating an example of a magnet-fixing section of an assembly jig which fixes a magnet by an attraction force, the assembly jig being used for the conventional assembly of a permanent magnet magnetic circuit, wherein FIG. 14A shows a side schematic diagram and FIG. 14B shows a schematic diagram observed from a side C in the direction indicated by the dashed-line arrow; and FIGS. 15A and 15B show a schematic diagram illustrating an example of a magnet-fixing section of an assembly jig which fixes a magnet unit by a screw, the assembly jig being used for the conventional assembly of a permanent magnet magnetic circuit, wherein FIG. 15A shows a side schematic diagram and FIG. 15B is a schematic diagram observed from a side D in the direction indicated by the dashed-line arrow.

DETAILED DESCRIPTION OF THE PREFERRED EMBODIMENTS

Figure 1:
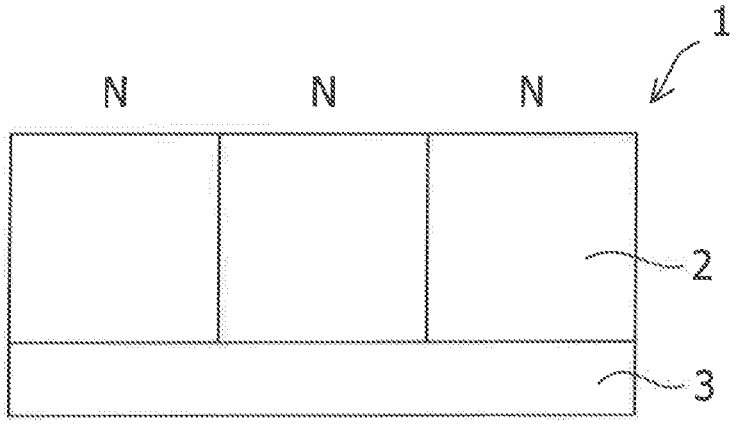
FIG. 1 shows a schematic diagram illustrating an example of a permanent magnet magnetic circuit which allows unmagnetized magnets to be attached to a yoke and then magnetized, wherein the directions of the polarities of adjacent magnets are the same.

According to the invention, in the method for producing a permanent magnet magnetic circuit, a permanent magnet or a magnet unit having a permanent magnet fixed to a backplate is fixed to an assembly jig through an electrically detachable adhesive in a step of fixing to the assembly jig. Then, the permanent magnet or magnet unit fixed to the assembly jig is fixed to a desired position on a yoke in a step of fixing to the yoke. After the permanent magnet or magnet unit is fixed to the yoke, a voltage is applied between the assembly jig and the permanent magnet or magnet unit so as to detach the electrically detachable adhesive from the permanent magnet or magnet unit or to detach the electrically detachable adhesive from the assembly jig so as to detach the permanent magnet or magnet unit from the assembly jig in a step of detaching from the assembly jig. As a result, a permanent magnet magnetic circuit comprising the permanent magnet or magnet unit and the yoke can be assembled. Fixing the permanent magnet to the assembly jig by using the electrically detachable adhesive makes it possible to stably fix the magnet to the assembly jig until the magnet is fixed to the yoke, and then after fixing the magnet to the yoke, to detach the adhesive from a desired side, which is the magnet side or the assembly jig side, by passing of electric current for reducing the adhesive force, thus permitting easy detachment of the magnet from the assembly jig. Even when a permanent magnet magnetic circuit to be produced is changed so that the size or the shape of a magnet is changed, modification of the coating area, an amount or the like of the adhesive can deal with such a change successfully. Consequently, a general-purpose assembly jig can be used or an existing assembly jig can be reused without changing the structure of the assembly jig, which is of great advantage. In addition, since there is no need for a magnetic material to attract a magnet to an assembly jig or for forming a through hole or the like for screwing a magnet, the structure of the assembly jig itself can be simplified.

In the invention, the electrically detachable adhesive is an adhesive resin material having a property in which the adhesion strength thereof decreases upon passing of a current (i.e. application of a voltage), causing the detachment along the interface between the attached body and the adhesive. As the electrically detachable adhesive, a publicly known electrically detachable adhesive can be used, such as an epoxy-based electrically detachable adhesive containing an epoxy-based compound, or a two-component mixed type acrylic electrically detachable adhesive containing an acrylic polymer and an electrolyte. Preferable examples thereof include "ElectRelease (trademark) E4" produced by Taiyo Wire Cloth Co., Ltd, having the characteristics that when a DC voltage of 10V to 50V is applied for ten seconds to several minutes between the bodies bonded through the adhesive, an electrochemical reaction takes place at the interface between one body on an anode side and the adhesive, leading to a decrease in the adhesive strength, so that the detachment can take place along the interface between one body on the anode side and the adhesive. The detachment reaction always takes place on the anode side. Accordingly, when the polarity of the voltage to be applied between the two bonded bodies is reversed and then the voltage is applied in the same manner, the detachment can take place along the interface between the other body and the adhesive. This means that both surfaces of the adhesive can be detached from both of the bodies. Advantageously, no adhesive layer remains on a surface of each body after the detachment, and no gas or heat is generated during the detachment. In addition, sufficient adhesion strength is obtained before the detachment.

Figure 2:
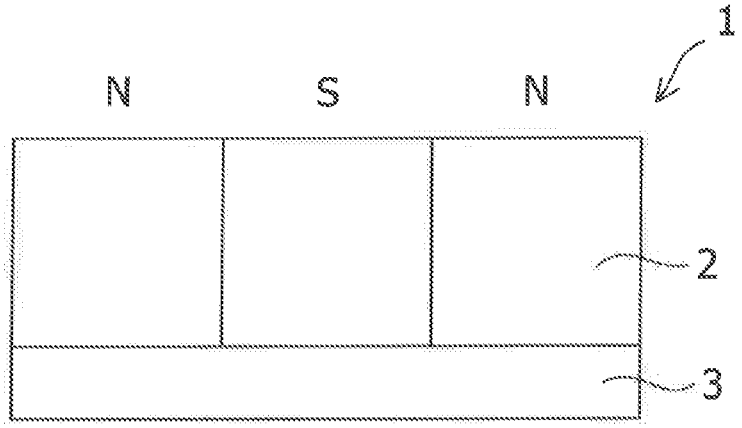
FIG. 2 shows a schematic diagram illustrating an example of a permanent magnet magnetic circuit which requires magnetized magnets to be attached to a yoke, wherein the directions of the polarities of adjacent magnets are opposite from each other.

Embodiments of the invention will be described with reference to the accompanying drawings. FIG. 1 shows a schematic diagram illustrating an example of a permanent magnet magnetic circuit that can be produced in the assembly-before-magnetization method, in which unmagnetized permanent magnets are attached to a yoke and then magnetized after the attachment. The directions of the polarities of adjacent magnets are the same. In FIG. 1, a permanent magnet magnetic circuit 1 comprises a plurality of the permanent magnets 2 and a yoke 3. The directions of magnetization of the permanent magnets 2 are the same, so that if the entire permanent magnet magnetic circuit 1 has a size that enables the permanent magnet magnetic circuit 1 to be magnetized by an electromagnet or a pulse magnetizer, then the permanent magnet magnetic circuit 1 can be easily produced by the assembly-before-magnetization method in which unmagnetized magnets are attached to a yoke and then magnetized. On the other hand, FIG. 2 shows a schematic diagram illustrating an example of a permanent magnet magnetic circuit required to be assembled using magnetized permanent magnets, wherein the directions of the polarities of adjacent magnets are opposite from each other. In FIG. 2, the permanent magnet magnetic circuit 1 comprises a plurality of permanent magnets 2 and the yoke 3, and the directions of magnetization of adjacent permanent magnets 2 are opposite, so that the magnets cannot be magnetized at the same time by an electromagnet or a pulse magnetizer. For this reason, the assembly-after-magnetization method is required in which magnets are magnetized in advance and then the magnetized magnets are directly attached to a yoke. However, the assembly-after-magnetization method generally creates a problem related to the attraction force and the repulsive force between permanent magnets and a yoke and between the permanent magnets during assembly. According to the invention, the production method allows magnets to be stably attached to a yoke by fixing magnets to an assembly jig through an electrically detachable adhesive. Thus, the production method is suitable, as shown in FIG. 2, for the assembly-after-magnetization method which has the problem related to the attraction force and the repulsive force especially between permanent magnets and a yoke and between the permanent magnets. According to the invention, the production method can be of course used in the assembly-before-magnetization method as shown in FIG. 1.

The permanent magnet 2 may be an electrically good conductor material, for example, a sintered rare-earth permanent magnet such as a neodymium-iron-boron-base sintered magnet and a samarium-cobalt-base sintered magnet. A sintered rare-earth permanent magnet can be made by pressure-molding rare-earth magnetic powder, and then sintering and magnetizing the molded product. As the permanent magnet 2, an insulator magnet subjected to surface treatment using an electrically conductive material, especially a material with high electrical conductivity, may be used. The material with high electrical conductivity to be used for the surface treatment may be, for example, nickel, aluminum, copper, gold or an alloy thereof. The shape or size of the permanent magnet 2 is not particularly limited. It is preferably a nearly cubic magnet having one side of, for example, from 4 cm to 10 cm from the standpoint of ease of magnetization and stable fixation to an assembly jig. The volume of the permanent magnet 2 is preferably 1000 $cm^3$ or less, more preferably from 100 $cm^3$ to 1000 $cm^3$. To produce a large permanent magnet magnetic circuit, a plurality of said magnets may be combined to form a large magnet. The material of the yoke 3 may be a magnetic material or a nonmagnetic material. Typically, iron is frequently used for the yoke 3.

<Attachment of a Discrete Magnet to a Yoke>

Figure 3A:
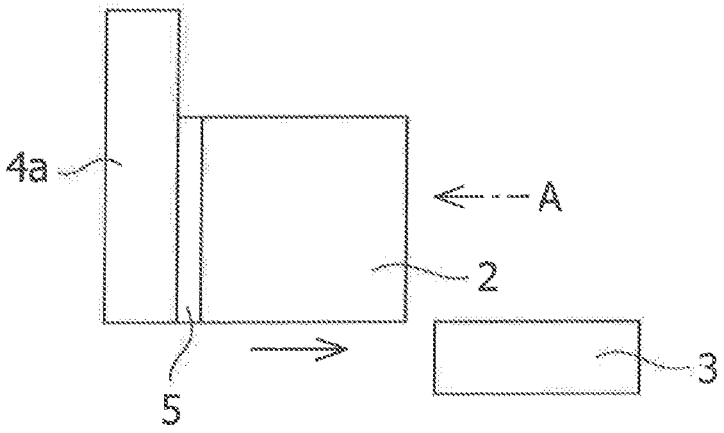
Figure 3B:
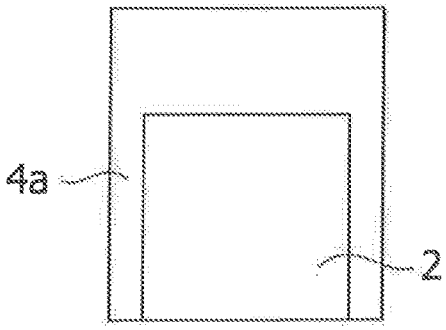

FIGS. 3A and 3B show schematic diagrams illustrating an example of the step of attaching the permanent magnet 2 that has been magnetized to the yoke 3. FIG. 3A shows a side schematic diagram and FIG. 3B show a schematic diagram of a magnet-fixing section observed from a side A in the direction indicated by a dashed-line arrow. First, the permanent magnet 2 that has been magnetized is fixed to a magnet-fixing section 4*a* of an assembly jig. The fixation of the permanent magnet 2 to the magnet-fixing section 4*a* of the assembly jig is made through an electrically detachable adhesive 5. The electrically detachable adhesive 5 is applied to at least one of the magnet-fixing section 4*a* of the assembly jig and the permanent magnet 2 to attach the permanent magnet 2 to the magnet-fixing section 4*a* of the assembly jig.

Subsequently, the permanent magnet 2 fixed to the magnet-fixing section 4*a* of the assembly jig is attached to the yoke 3. The permanent magnet 2 is attached to the yoke 3 basically by sliding. The sliding refers to a method in which the permanent magnet 2 is inserted from the side by moving the permanent magnet 2 on the surface of the yoke 3 in a sliding manner to place the permanent magnet 2 at a desired position on the yoke 3. Especially when a magnetic yoke is used, the placing method based on the sliding is required to restrict the lateral displacement due to the attraction force or the repulsive force from a magnet that has already been placed, since the position of the magnet in a vertical direction is maintained because of the attraction of the magnet to the yoke. This method allows the magnets to be placed more stably than a method in which magnets are vertically brought close to the surface of the yoke 3 from above the yoke 3.

Figure 4:
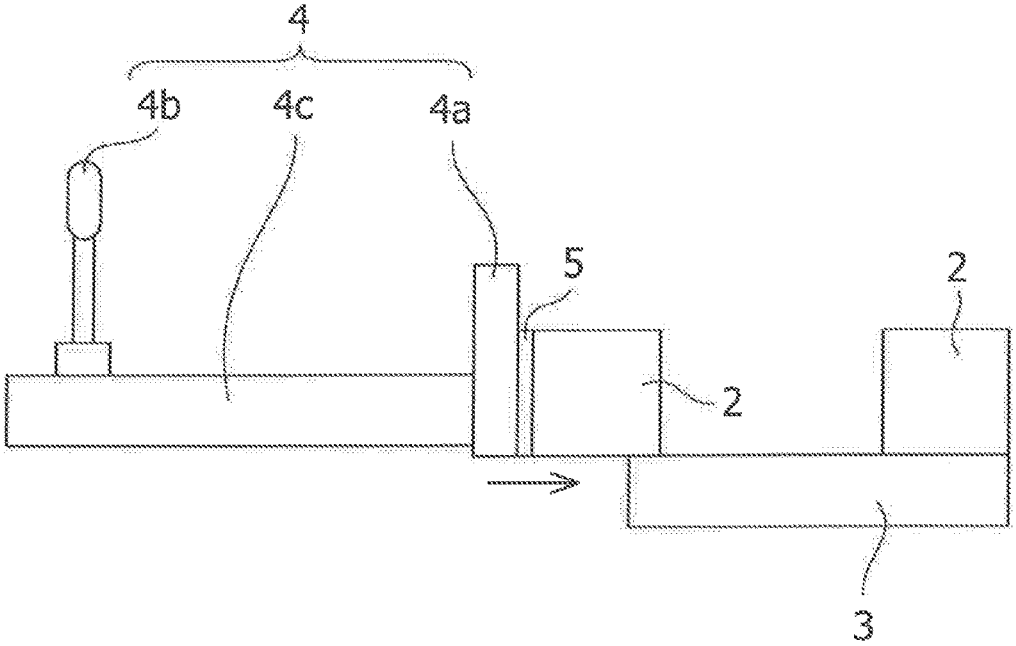
FIG. 4 shows a schematic diagram illustrating an example of an assembly jig used to attach magnets to a yoke in the method for producing a permanent magnet magnetic circuit in accordance with the invention.

As the assembly jig to be used for the sliding (i.e. slide-in jig), for example, an assembly jig 4 (i.e. a slide-in jig 4) comprising a magnet-fixing section 4*a*, a driving means 4*b*, and a push-in bar 4*c* can be used as shown in FIG. 4. According to the invention, the assembly jig to be used is not limited thereto, and a publicly known assembly jig may be used in accordance with the type or the like of a permanent magnet magnetic circuit to be produced. In the example of FIG. 4, the push-in bar 4*c* attached to the magnet-fixing section 4*a* is pushed into the lateral direction, the direction indicated by the arrow, from the outer side of the yoke 3 by using the driving means 4*b* such as a ball screw or a jack bolt, and the permanent magnet 2 fixed to the magnet-fixing section 4*a* is slid to a desired position on the yoke 3. A nonmagnetic material such as aluminum is used for the magnet-fixing section 4*a*. The driving means 4*b* may be a relatively simple device capable of pushing the magnet-fixing section 4*a* in one direction, and may include a driving device such as a manual driving device, a drive motor and a hydraulic driving device, as well as the above examples. As the push-in bar 4*c*, for example, a plurality of plastic rods may be combined and used. The permanent magnet 2 can be stably attached to the yoke 3 despite an attraction force generated from an adjacent magnet having an opposite polarity which has already been attached since the permanent magnet 2 has been fixed to the magnet-fixing section 4*a* through the electrically detachable adhesive 5.

In order to make it easier to attach the permanent magnet 2 to the yoke 3, for example, a groove (not shown) having a width equal to the width of the magnet may be provided in the surface of the yoke 3. The groove is formed to extend to the outer end surface of the yoke 3 so as to allow the permanent magnet 2 to be easily attached to the yoke 3 by sliding the magnet in the groove from the outer side of the yoke 3. During sliding of the permanent magnet 2 for the attachment to the yoke 3, a lubricant such as grease may be applied to the groove. This will reduce the frictional force to allow the magnet to be slid to a desired position of the yoke 3 more easily. Further, a guiderail (not shown) for guiding the permanent magnet 2 may be installed on the yoke 3. The guiderail can be made of a nonmagnetic material such as aluminum. However, installment of such a groove or a guiderail is not essential. The permanent magnet 2 is fixed to the magnet fixing section 4*a* through the electrically detachable adhesive 5 so that the permanent magnet 2 can be placed at a desired position on the yoke 3 in the absence of such a groove or a guiderail.

The permanent magnet 2 placed at a desired position on the yoke 3 by the assembly jig 4 is then fixed to the yoke 3. The method for fixing the permanent magnet 2 to the yoke 3 is not particularly limited. For example, the permanent magnet 2 may be fixed through an ordinary adhesive which is not the electrically detachable adhesive, or may be physically fixed using a metal member or the like. The ordinary adhesive means an adhesive which can be cured by reaction at room temperature, including an epoxy-based adhesive or an acrylic adhesive but excluding the electrically detachable adhesive. As an example of the physical fixing, a magnet is placed on a yoke, a cover made of a nonmagnetic material is placed over the magnet, and the cover is fixed to the yoke using a bolt or the like. Further, a publicly known holding jig may be used to fix the magnet to the yoke. Fixing by an adhesive and the physical fixing may be combined.

Figure 5:
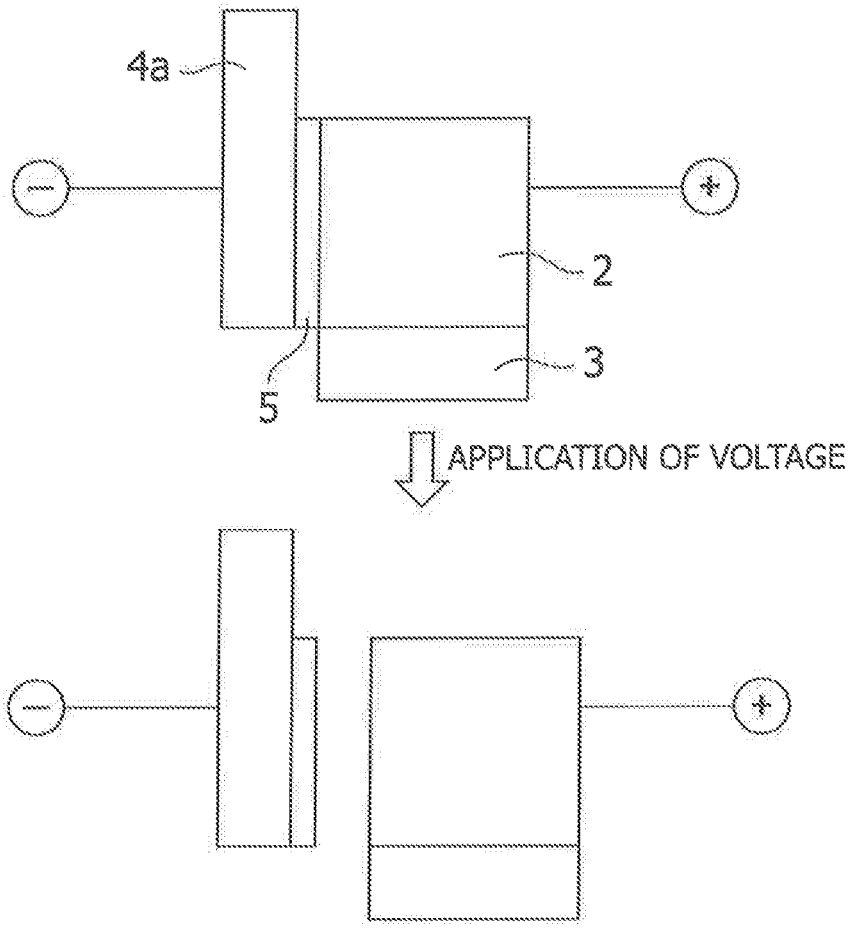
FIG. 5 shows schematic diagrams illustrating an example of a step of detaching a magnet fixed to a yoke from an assembly jig in the method for producing a permanent magnet magnetic circuit in accordance with the invention, wherein an anode terminal is connected to the magnet and a cathode terminal is connected to a magnet-fixing section of the assembly jig, and a voltage is applied between the two terminals to detach an electrically detachable adhesive from the magnet.

After fixing the permanent magnet 2 to the yoke 3, the permanent magnet 2 is detached from the magnet-fixing section 4*a* of the assembly jig. FIG. 5 shows schematic diagrams illustrating an example of the step of detaching the permanent magnet 2 from the magnet-fixing section 4*a* of the assembly jig. As illustrated in the upper diagram of FIG. 5, an anode terminal of a DC power source is connected to the permanent magnet 2 and a cathode terminal of the DC power source is connected to the magnet-fixing section 4*a* of the assembly jig on an insulating base (not shown), and a voltage is applied between the anode terminal and the cathode terminal. As a result, the permanent magnet 2 can be detached along the interface between the permanent magnet 2 to which the anode is connected and the electrically detachable adhesive 5, from the magnet-fixing section 4*a* of the assembly jig as shown in the lower diagram of FIG. 5. Optionally, the anode terminal and the cathode terminal are reversed and then a voltage is applied again in the same manner to allow the electrically detachable adhesive 5 to be detached also from the magnet-fixing section 4*a*. For example, a metal plate (not shown) is placed on an exposed surface of electrically detachable adhesive 5 after the detachment of the permanent magnet 2; the cathode terminal is connected to the metal plate, while the anode terminal is connected to the magnet fixing section 4*a*; and a voltage is applied. This allows the electrically detachable adhesive 5 to be detached also from the magnet-fixing section 4*a*.

Figure 6:
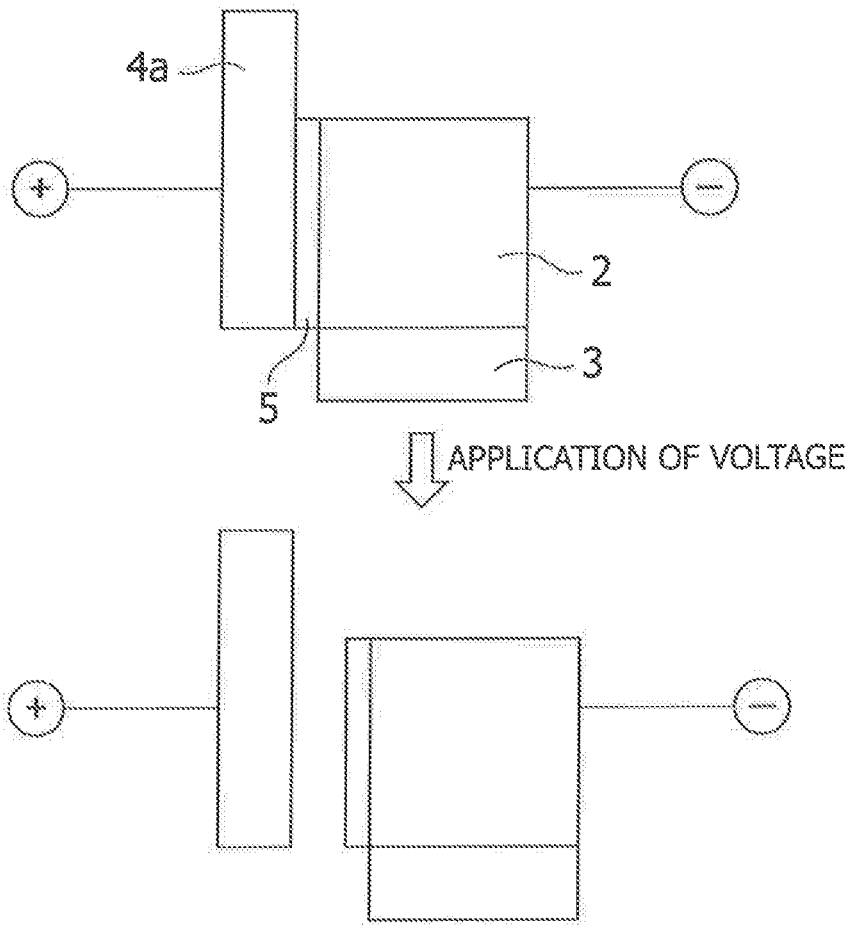
FIG. 6 shows schematic diagrams illustrating an example of a step of detaching a magnet fixed to a yoke from an assembly jig in the method for producing a permanent magnet magnetic circuit in accordance with the invention, wherein a cathode terminal is connected to the magnet and an anode terminal is connected to a magnet-fixing section of the assembly jig, and a voltage is applied between the two terminals to detach an electrically detachable adhesive from the magnet-fixing section.

Alternatively, the permanent magnet 2 can be detached from the magnet-fixing section 4*a* of the assembly jig as described below. FIG. 6 shows a schematic diagram illustrating a step of detaching the permanent magnet 2 from the magnet-fixing section 4*a* of the assembly jig. As shown in the upper diagram of FIG. 6, the cathode terminal of the DC power source is connected to the permanent magnet 2 and the anode terminal of the DC power source is connected to the magnet-fixing section 4*a* of the assembly jig on an insulating base (not shown), and a voltage is applied between the cathode terminal and the anode terminal. The permanent magnet 2 is detached along the interface between the magnet-fixing section 4*a* to which the anode is connected and the electrically detachable adhesive 5, from the magnet-fixing section 4*a* of the assembly jig, while keeping the electrically detachable adhesive 5 on the surface of the permanent magnet 2, as shown in the lower diagram of FIG. 6. This method allows the electrically detachable adhesive 5 to be left on the surface of the permanent magnet 2, so that an antirust effect can be advantageously expected for the surface of the permanent magnet 2. Hence, it is preferable from the standpoint of the antirust effect to use the detachment method comprising the steps of connecting the cathode terminal of a DC power source to the permanent magnet 2, connecting the anode terminal of the DC power source to the magnet fixing section 4*a* of an assembly jig, and then applying a voltage therebetween. Alternatively, if there is no need to leave the electrically detachable adhesive 5 on the surface of the permanent magnet 2, then the anode terminal and the cathode terminal are reversed and a voltage is applied again in the same manner to allow the electrically detachable adhesive 5 to be detached also from the permanent magnet 2. The coating thickness of the electrically detachable adhesive 5*e* is not particularly limited insofar as the coating thickness is sufficient for fixing the permanent magnet 2 to the magnet-fixing section 4*a* of an assembly jig. The coating thickness of the electrically detachable adhesive 5 is preferably from 5 to 100 μm from the standpoint of the antirust effect for the surface of the permanent magnet 2. Thus, the permanent magnet 2 can be detached from the magnet-fixing section 4*a* of the assembly jig and attached to the yoke 3 to produce the permanent magnet magnetic circuit 1.

<Attachment of a Magnet Unit to a Yoke>

Figure 7:
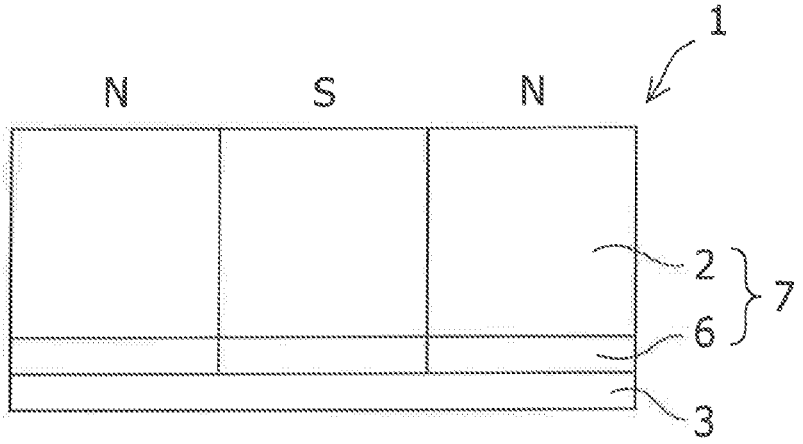
FIG. 7 shows a schematic diagram illustrating an example of a permanent magnet magnetic circuit in which a permanent magnet is fixed to a backplate to form a magnet unit, and the directions of the polarities of adjacent magnets are opposite from each other.

FIG. 7 shows a schematic diagram illustrating an example of the permanent magnet magnetic circuit 1 in which a magnet unit 7 comprises the permanent magnet 2 fixed to a backplate 6, the polarity directions of adjacent magnets being opposite from each other. In FIG. 7, the permanent magnet magnetic circuit 1 comprises a permanent magnet 2, a backplate 6 and a yoke 3, wherein the permanent magnet 2 and the backplate 6 are combined for integration to form a magnet unit 7. The magnetization directions of the adjacent permanent magnets 2 are different from each other, so that the permanent magnets 2 cannot be magnetized at the same time by an electromagnet or a pulse magnetizer after attachment of the permanent magnets 2 to the yoke 3. Therefore, it is necessary to carry out the assembly-after-magnetization method, in which magnets that have been magnetized in advance are attached to a yoke.

Figure 8A:
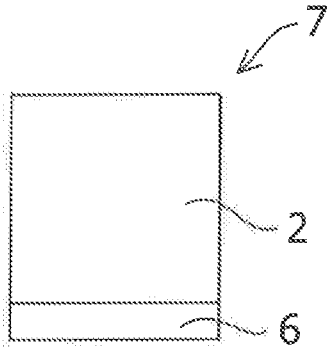

FIG. 8A shows a schematic diagram of the magnet unit 7 comprising the permanent magnet 2 and the backplate 6. The magnet unit 7 has the permanent magnet 2 fixed to the backplate 6 in an integrated form. The backplate 6 may be attached to the permanent magnet 2 through the ordinary adhesive which is not an electrically detachable adhesive, or may be physically fixed using a metal member. The ordinary adhesive includes an epoxy-based adhesive and an acrylic adhesive but excludes an electrically detachable adhesive as described above. Further, the material of the backplate 6 may be a magnetic material or a nonmagnetic material, and may be, for example, iron or aluminum. If the material of the backplate 6 is a magnetic material, then the backplate 6 is fixed to the permanent magnet 2 to form the magnet unit 7, which is magnetized by a magnetostatic field produced by an electromagnet or in a pulsed magnetic field. If the material of the backplate 6 is a nonmagnetic material, then the permanent magnet 2 is magnetized by the magnetostatic field produced by an electromagnet or by a pulsed magnetic field to obtain the magnetized permanent magnet 2, which is fixed to the backplate 6 for integration to form the magnet unit 7. In FIG. 8A, the backplate 6 has a sectional area substantially equal to that of the permanent magnet 2, wherein the sectional area means an area of a section parallel to the direction in which the magnet is slid to the yoke.

Figure 8B:
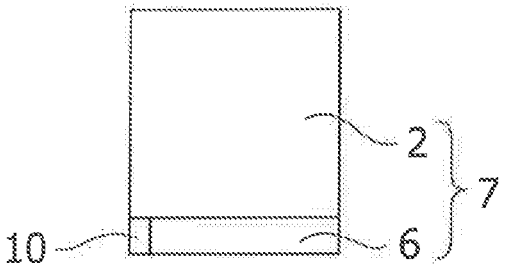

FIG. 8B shows a preferred example in which an electric resistance regulator plate 10 is further disposed on the surface of the backplate 6 that is in contact with the electrically detachable adhesive 5, that is, between the backplate 6 and the electrically detachable adhesive 5. The electric resistance regulator plate 10 on the surface of the backplate 6, which surface comes in contact with the electrically detachable adhesive 5, makes it possible to set the electrical resistances at the portion of the permanent magnet 2 and at the portion of the backplate 6 (i.e. the portion of the electric resistance regulator plate 10) in the magnet unit 7 to be approximately at the same level. This enables the portion of the permanent magnet 2 and the portion of the backplate 6 (i.e. the portion of the electric resistance regulator plate 10) to be smoothly detached at the same time when the electrically detachable adhesive 5 is detached from the magnet unit 7 by passing a current (i.e. applying a voltage) to the electrically detachable adhesive 5, which will be discussed hereinafter. For this reason, the electrical resistance of the electric resistance regulator plate 10 is preferably close to the electrical resistance of the permanent magnet 2. More preferably, the electrical resistance of the electric resistance regulator plate 10 is approximately the same as that of the permanent magnet 2. From the standpoints of cost-effectiveness, the total sectional area of the electric resistance regulator plate 10 and the backplate 6 (i.e. the total sectional area in the section parallel to the direction in which the magnet is slid to the yoke) is preferably approximately the same as the sectional area of the permanent magnet 2 as shown in FIG. 8B. Alternatively, the electric resistance regulator plate 10 may be added to the surface of the backplate 6, which has the sectional area substantially the same as that of the permanent magnet 2 as shown in FIG. 8A, such that the electric resistance regulator plate 10 projects (not shown), wherein the surface of the backplate 6 is the surface to be in contact with the electrically detachable adhesive 5. The material of the electric resistance regulator plate 10 may be, for example, stainless steel. Further, the electric resistance regulator plate 10 is preferably a permanent magnet of the same material as that of the permanent magnet 2. The electric resistance regulator plate can be bonded to the magnet unit by using, for example, the ordinary adhesive such as an epoxy-based adhesive and an acrylic adhesive, which is not an electrically detachable adhesive.

Figure 8C:
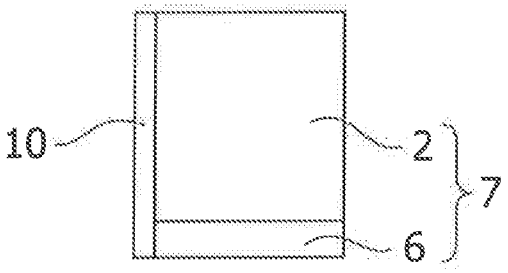

Preferably from the same viewpoint, the electric resistance regulator plate 10 is further disposed on both of the surface of the permanent magnet 2, which surface is to be in contact with the electrically detachable adhesive 5, and the surface of the backplate 6, which surface is to be in contact with the electrically detachable adhesive 5, that is, between the electrically detachable adhesive 5 and each of the permanent magnet 2 and the backplate 6 as shown in FIG. 8C. Fixation of the magnet unit 7 to the yoke 3 and detachment of the magnet unit 7 from the assembly jig will be explained by referring to the example of using the magnet unit 7 without an electric resistance regulator plate 10 as shown in FIG. 8A. The same method of fixation and detachment is applicable for the example of using the magnet unit 7 with the electric resistance regulator plate 10 added only to the surface of the backplate 6, which surface is to be in contact with the electrically detachable adhesive 5 as shown in FIG. 8B. It is also applicable for the embodiment of using the magnet unit 7 with the electric resistance regulator plate 10 added to both of the surface of the permanent magnet 2, which surface is to be in contact with the electrically detachable adhesive 5, and the surface of the backplate 6, which surface is to be in contact with the electrically detachable adhesive 5, wherein the electric resistance regulator plate 10 extends over the permanent magnet 2 and the backplate 6 as shown in FIG. 8C.

Figure 9A:
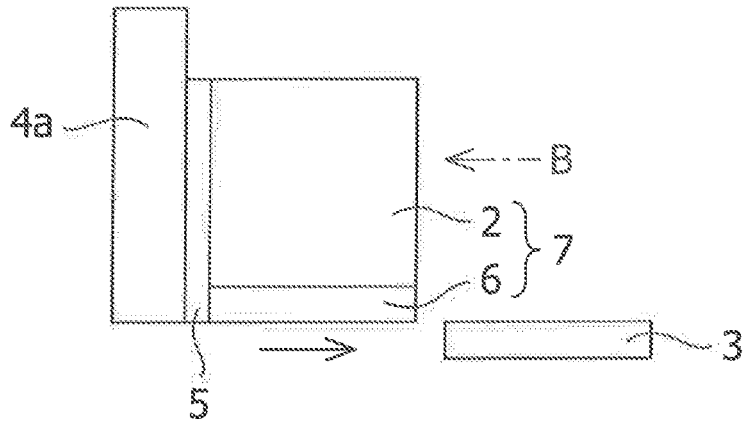
Figure 9B:
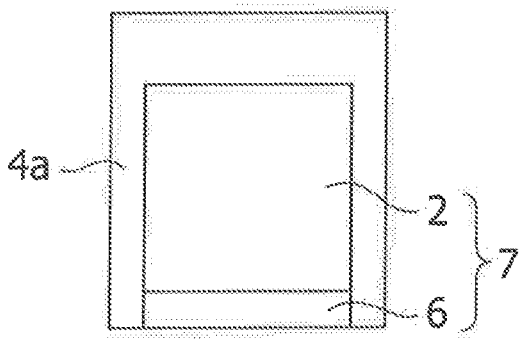
Figure 10:
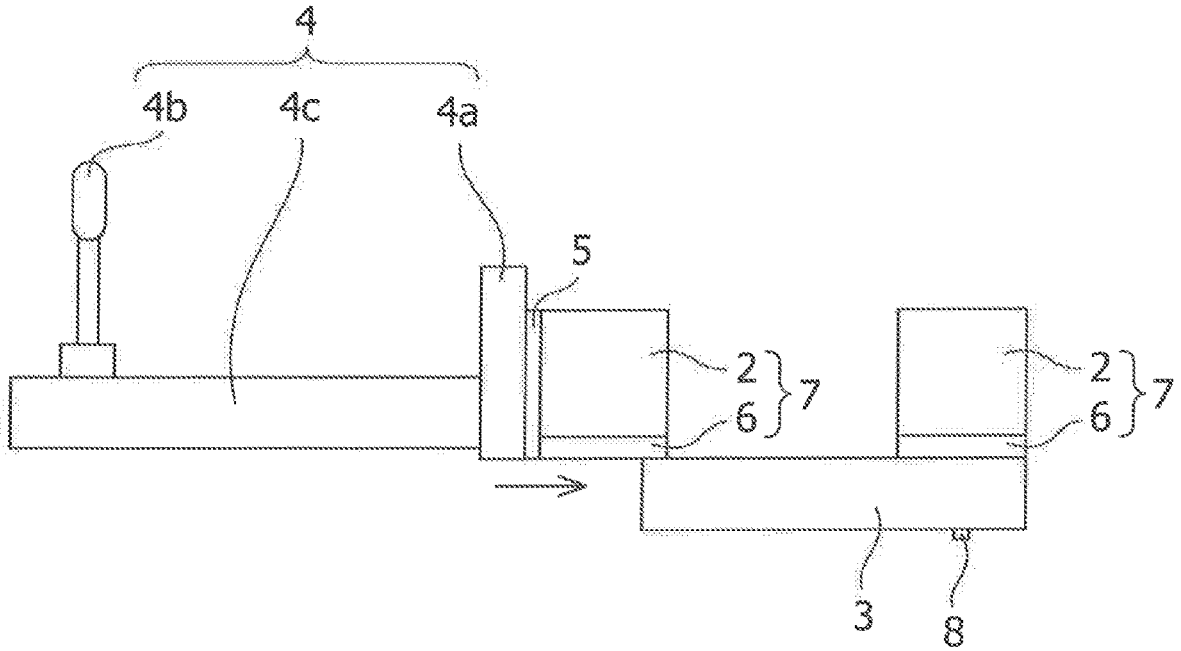
FIG. 10 shows a schematic diagram illustrating an example of an assembly jig used to attach a magnet unit to a yoke in the method for producing a permanent magnet magnetic circuit in accordance with the invention.

FIGS. 9A and 9B show schematic diagrams illustrating an example of the step of attaching the magnet unit 7, which has been magnetized as described above, to the yoke 3. FIG. 9A shows a side schematic diagram and FIG. 9B shows a schematic diagram of the magnet unit observed from a side B in the direction indicated by the dashed-line arrow. The magnet unit 7, which has been magnetized, is fixed to the magnet-fixing section 4*a* of the assembly jig through the electrically detachable adhesive 5. The electrically detachable adhesive 5 is applied to at least one of the magnet-fixing section 4*a* of the assembly jig and the magnet unit 7 so as to bond the magnet-fixing section 4*a* of the assembly jig and the magnet unit 7. Then, the permanent magnet 2 fixed to the magnet-fixing section 4*a* of the assembly jig is attached to the yoke 3 by sliding with the publicly known assembly jig in the same manner as in the aforementioned attachment of the discrete magnet to the yoke. In the example shown in FIG. 10, the push-in bar 4*c* attached to the magnet-fixing section 4*a* is pushed in the lateral direction from the outer side of the yoke 3 by using the driving means 4*b* such as a ball screw and a jack bolt so as to slide the magnet unit 7, which has been fixed to the magnet fixing section 4*a*, to a desired position on the yoke 3.

The magnet unit 7 placed at the desired position on the yoke 3 by the assembly jig is then fixed to the yoke 3. The method for fixing the magnet unit 7 to the yoke 3 is not particularly limited. For example, the magnet unit 7 may be fixed through the ordinary adhesive which is not an electrically detachable adhesive, or may be physically fixed by a metal member or the like. The ordinary adhesive includes an epoxy-based adhesive and an acrylic adhesive but excludes an electrically detachable adhesive, as described above. As an example of the physical fixing, the magnet unit 7 is fixed to the yoke 3 using a screw 8 and a screw hole (not shown) tapped in the backplate 6. Although it is difficult to carry out machining, such as tapping, of a permanent magnet itself, the magnet unit 7 comprising the permanent magnet 2 and the backplate 6 in an integrated form permits easy machining, such as tapping of the backplate 6 to form the screw hole. Thus, fixation of the magnet unit 7 to the yoke 3 becomes easy.

Figure 11:
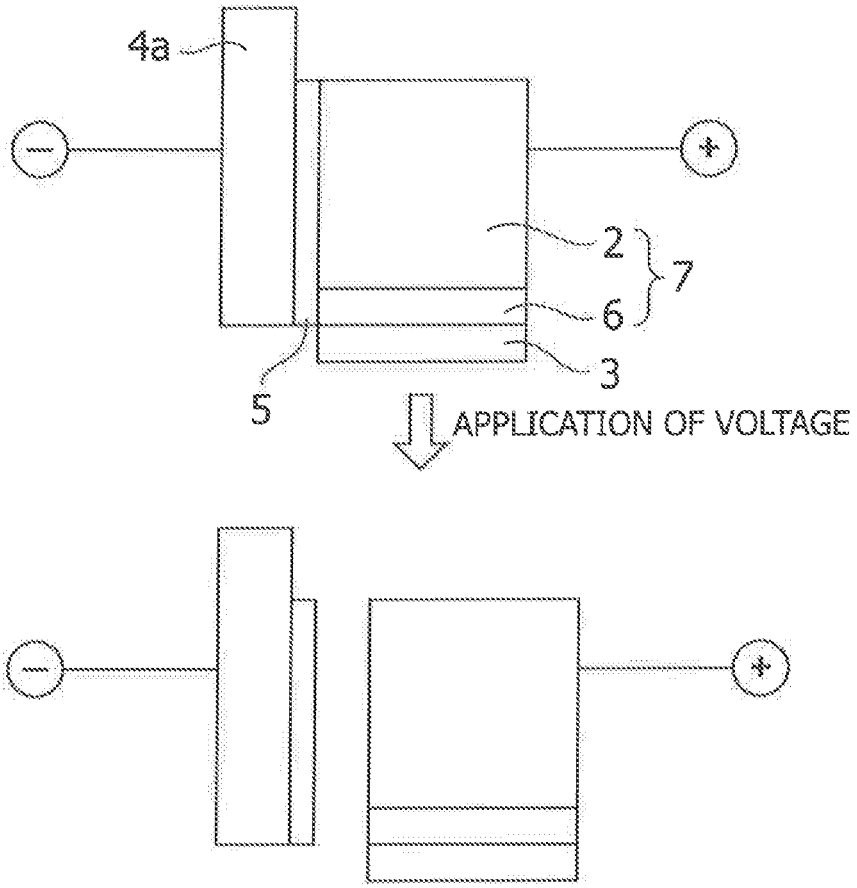
FIG. 11 shows schematic diagrams illustrating an example of a step of detaching a magnet unit fixed to a yoke from an assembly jig in the method for producing a permanent magnet magnetic circuit in accordance with the invention, wherein an anode terminal is connected to the magnet unit and a cathode terminal is connected to a magnet-fixing section of the assembly jig, and a voltage is applied between the two terminals to detach an electrically detachable adhesive from the magnet unit.

After the fixation of the magnet unit 7 to the yoke 3, the magnet unit 7 is detached from the magnet-fixing section 4*a* of the assembly jig. FIG. 11 shows schematic diagrams illustrating an example of the step of detaching the magnet unit 7 from the magnet-fixing section 4*a* of the assembly jig. As shown in the upper diagram of FIG. 11, an anode terminal is connected to the magnet unit 7 and a cathode terminal is connected to the magnet-fixing section 4*a* of the assembly jig on an insulating base (not shown), and a voltage is applied between the anode terminal and the cathode terminal. The magnet unit 7 can be detached along the interface between the magnet unit 7 to which the anode is connected and the electrically detachable adhesive 5, from the magnet fixing section 4*a* of the assembly jig as shown in the lower diagram of FIG. 11. Optionally, the anode terminal and the cathode terminal are reversed and then a voltage is applied again in the same manner to allow the electrically detachable adhesive 5 to be detached also from the magnet-fixing section 4*a*. For example, a metal plate (not shown) is placed on an exposed surface of the electrically detachable adhesive 5 after the detachment of the magnet unit 7, the cathode terminal is connected to the metal plate and the anode terminal is connected to the magnet-fixing section 4*a*, and a voltage is applied so as to allow the electrically detachable adhesive 5 to be detached also from the magnet fixing section 4*a*.

Figure 12:
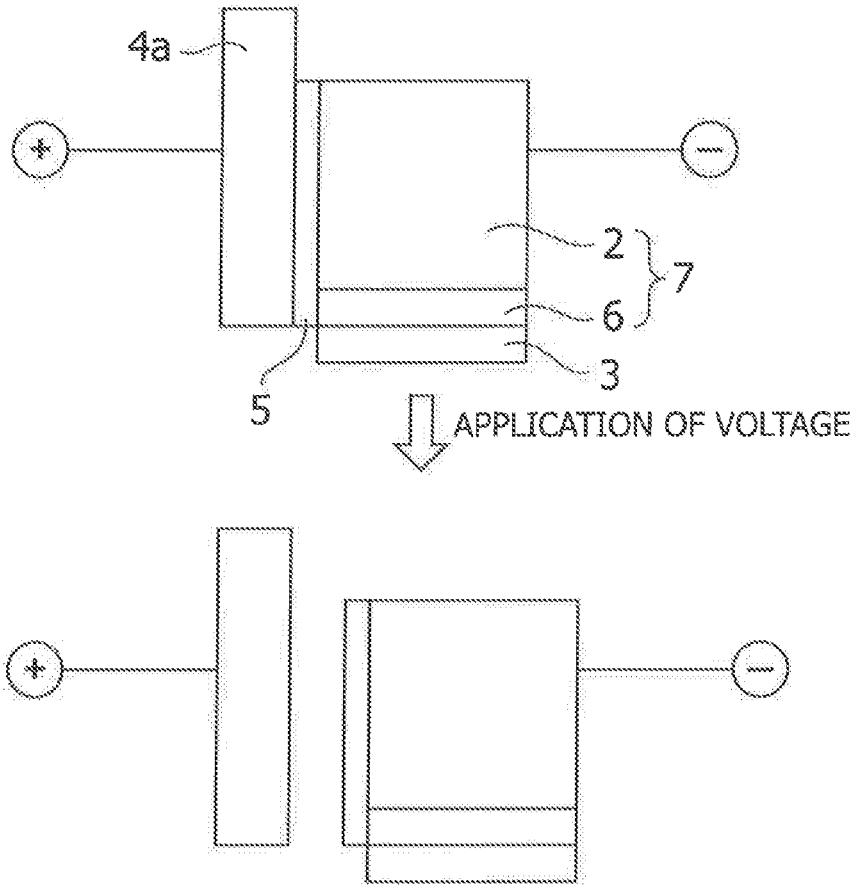
FIG. 12 shows a schematic diagram illustrating an example of a step of detaching a magnet unit fixed to a yoke from an assembly jig in the method for producing a permanent magnet magnetic circuit in accordance with the invention, wherein a cathode terminal is connected to the magnet unit and an anode terminal is connected to a magnet-fixing section of the assembly jig, and a voltage is applied between the two terminals to detach an electrically detachable adhesive from the magnet fixing section.
Figure 13:
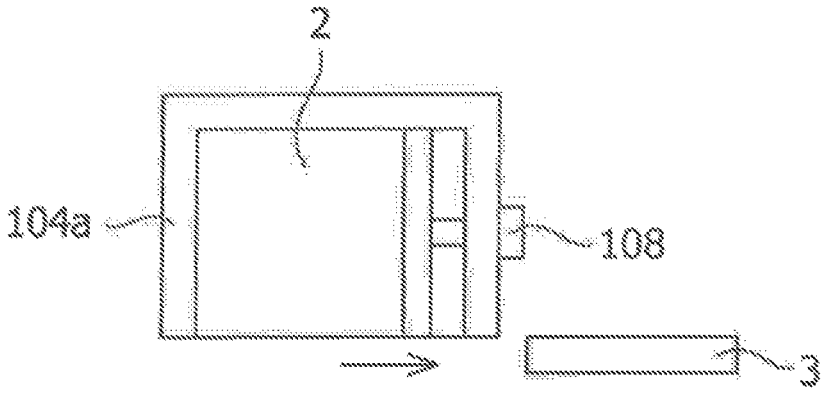
FIG.13 PRIOR ART
FIG. 13 shows a schematic diagram illustrating an example of a magnet-fixing section of an assembly jig which fixes a magnet by a frictional force, the assembly jig being used for the conventional assembly of a permanent magnet magnetic circuit.
Figure 14A:
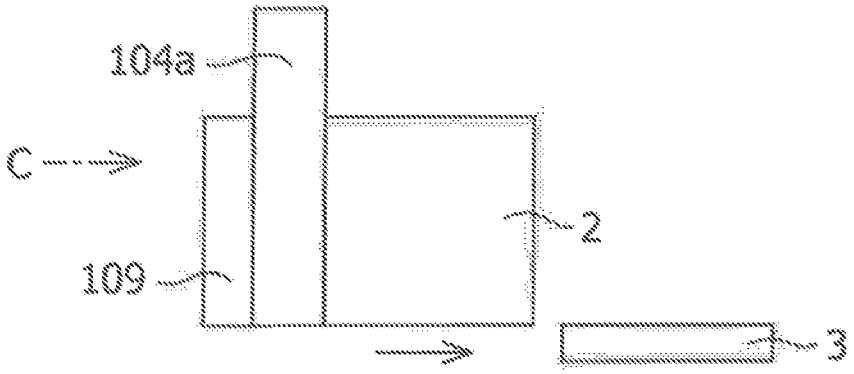
FIG.14A PRIOR ART
Figure 14B:
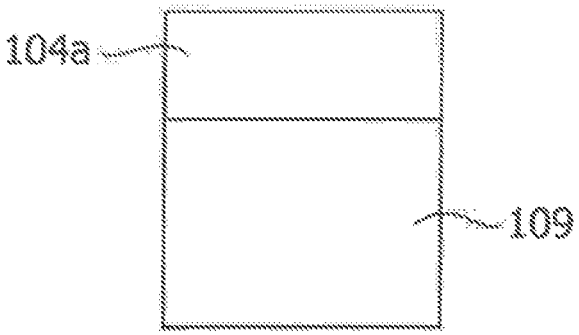
FIG.14B PRIOR ART
Figure 15A:
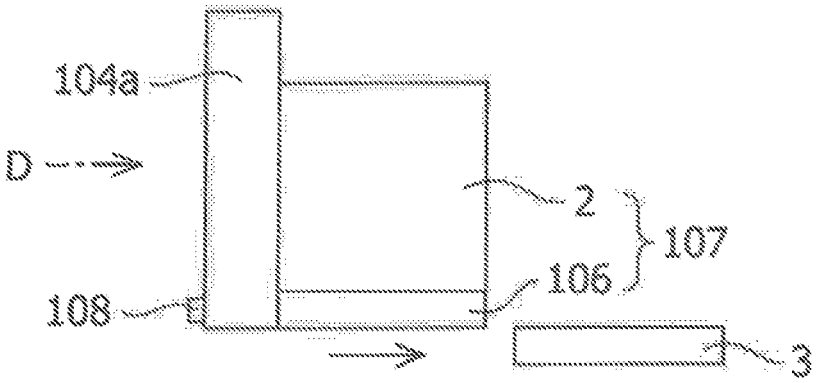
FIG.15A PRIOR ART
Figure 15B:
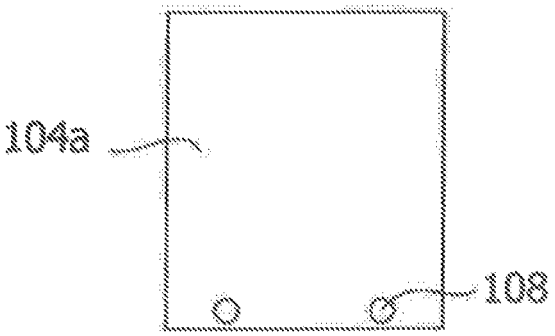
FIG.15B PRIOR ART

Alternatively, the magnet unit 7 can be detached from the magnet-fixing section 4*a* of the assembly jig as described below. FIG. 12 shows a schematic diagram illustrating a step of detaching the magnet unit 7 from the magnet-fixing section 4*a* of the assembly jig. As shown in the upper diagram of FIG. 12, the cathode terminal is connected to the magnet unit 7 and the anode terminal is connected to the magnet-fixing section 4*a* of the assembly jig on an insulating base (not shown), and a voltage is applied between the cathode terminal and the anode terminal. The magnet unit 7 can be detached along the interface between the magnet fixing section 4*a* to which the anode is connected and the electrically detachable adhesive 5, from the magnet-fixing section 4*a* of the assembly jig as shown in the lower diagram of FIG. 12. This method allows the electrically detachable adhesive 5 to be left on the surface of the magnet unit 7 so that an antirust effect can be advantageously expected for the permanent magnet 2, for example, in the magnet unit 7 shown in FIG. 8A or FIG. 8B in which the surface of the permanent magnet 2 adjacent to the magnet-fixing section 4*a* is exposed and the surface of the permanent magnet 2 is in direct contact with the electrically detachable adhesive 5. Further, according to this method, the electrically detachable adhesive 5 is detached from the magnet-fixing section 4*a*, so that smooth detachment can be advantageously accomplished in the absence of installment of the electric resistance regulator plate 10 adjacently to the magnet unit 7 as shown in FIG. 8B or FIG. 8C, that is, even in the presence of a simple structure as shown in FIG. 8A. Alternatively, if there is no need to leave the electrically detachable adhesive 5 on the surface of the magnet unit 7, then the anode terminal and the cathode terminal are reversed and a voltage is applied again in the same manner to allow the electrically detachable adhesive 5 to be detached also from the magnet unit 7. The coating thickness of the electrically detachable adhesive 5*e* is not particularly limited insofar as the coating thickness is sufficient to fix the magnet unit 7 to the magnet-fixing section 4*a* of the assembly jig. The coating thickness of the electrically detachable adhesive 5 is preferably from 5 to 100 μm from the standpoint of the antirust effect for the surface of the permanent magnet 2. Thus, the magnet unit 7 can be detached from the magnet-fixing section 4*a* of the assembly jig and attached to the yoke 3 to produce the permanent magnet magnetic circuit 1.

According to the invention, the production method is applicable to production of various types of permanent magnet magnetic circuits. Fr example, it is suitable for the production of various types of permanent magnet rotators such as those in wind power generators, air conditioners and hybrid vehicles, and for the production of magnetic field generators such as those in medical MRI devices. The production method is suitable for the production of large permanent magnet magnetic circuits such as wind power generators, the production involving the difficult fabrication by the assembly-before-magnetization method, in which magnets are magnetized after the attachment to a yoke, and requiring extra cost for preparation of assembly jigs. Although the embodiments of the invention have been described with reference to the accompanying drawings, it should not be construed that the invention is limited to or by these embodiments. Appropriate modification can be made without departing from the spirit of the invention.

The invention claimed is:

1. A method for producing a permanent magnet magnetic circuit comprising a magnet unit having a permanent magnet fixed to a backplate and a yoke on which the magnet unit is placed, the method comprising the steps of:

fixing the magnet unit to an assembly jig through an electrically detachable adhesive;

fixing the magnet unit, which has been fixed to the assembly jig, to the yoke; and applying a voltage between the magnet unit and the assembly jig to detach the electrically detachable adhesive from the magnet unit or to detach the electrically detachable adhesive from the assembly jig so as to detach the magnet unit from the assembly jig, wherein an electric resistance regulator plate is inserted between the backplate and the electrically detachable adhesive or between the electrically detachable adhesive and each of the permanent magnet and the backplate before the step of fixing the magnet unit to the assembly jig through the electrically detachable adhesive.

2. The method for producing a permanent magnet magnetic circuit according to claim 1, wherein the magnet unit has a volume of 1000 $cm^3$ or less.

3. The method for producing a permanent magnet magnetic circuit according to claim 1, wherein magnet unit is fixed to the yoke through an epoxy-based adhesive or an acrylic adhesive which is not an electrically detachable adhesive.

4. The method for producing a permanent magnet magnetic circuit according to claim 1, wherein the magnet unit is fixed to the yoke through a screw hole provided in the backplate.

5. The method for producing a permanent magnet magnetic circuit according to claim 1, wherein the permanent magnet magnetic circuit is a permanent magnet rotator or a magnetic field generator.

* * * * *